US005758437A

United States Patent [19]

Tamamoto

[11] Patent Number: 5,758,437

[45] Date of Patent: Jun. 2, 1998

[54] SLEEVE CUFF PRESSER OF SHIRT SLEEVE PRESS

[75] Inventor: Yuji Tamamoto, Moriyama, Japan

[73] Assignee: Fuji Car Mfg. Co. Ltd., Osaka, Japan

[21] Appl. No.: 787,292

[22] Filed: Jan. 24, 1997

[30] Foreign Application Priority Data

Jan. 25, 1996 [JP] Japan ..... 8-011184

[51] Int. Cl.[6] ..... D06F 71/24

[52] U.S. Cl. ..... 38/12; 223/52.1; 223/73; 38/35

[58] Field of Search ..... 38/12, 17, 66, 38/70, 35; 223/2, 3, 52.1, 68, 72, 73, 70, 71; 100/93 R, 93 P

[56] References Cited

U.S. PATENT DOCUMENTS

| | | | |
|---|---|---|---|
| 2,715,986 | 8/1955 | Ebner | 223/73 |
| 2,743,853 | 5/1956 | McLagan | 223/72 X |
| 2,969,897 | 1/1961 | Paris | 223/70 X |
| 4,057,179 | 11/1977 | Everett | 223/73 |

FOREIGN PATENT DOCUMENTS

| | | | |
|---|---|---|---|
| 600296 | 6/1994 | European Pat. Off. | 38/12 |
| 2213800 | 9/1987 | Japan | 223/70 |

*Primary Examiner*—Ismael Izaguirre
*Attorney, Agent, or Firm*—Wenderoth, Lind & Ponack

[57] ABSTRACT

A cuff presser which enables even an inexperienced operator to easily remove a shirt from a sleeve stretcher without wrinkling its sleeves and cuffs. The cuff presser has a cuff pressing member including two separate hollow cylindrical members. A cylinder is mounted in the cylindrical members. It has a rod pivotably carrying at its tip a pivot plate. A rod of another cylinder is mounted to the pivot plate. A leaf spring is fixed to the pivot plate. The pivot plate is pivoted by extending the second cylinder to open and close the leaf spring, which protrudes outwardly from a groove formed in the side of one of the cylindrical member, relative to the side face of the cylindrical member. The cylindrical member against which the leaf spring is pressed is moved by the first cylinder away from the other cylindrical member, on which is fitted a cuff.

2 Claims, 12 Drawing Sheets

SLEEVE CUFF PRESSER OF SHIRT SLEEVE PRESS

BACKGROUND OF THE INVENTION

This invention relates to a sleeve cuff presser of a shirt sleeve press for holding down a shirt sleeve cuff while pressing the sleeve with the press.

FIGS. 9 and 10 show a conventional cuff presser of this type disclosed in Unexamined Japanese Patent Publication 7-8695. A shirt sleeve 5 is pressed with its cuff 6 held down by a T-shaped leaf spring 31 against a cylindrical cuff presser 1 provided at the end of a sleeve stretcher 2 of a sleeve press. In the figures, 7 is a slit in the cuff. An anti-slip rubber plate 35 is fixed to the surface of the presser 1. A head 33 of the leaf spring 31 is pressed against the rubber plate 35 with the cuff 6 therebetween. The T-shaped leaf spring 31 has its leg 32 fixed to a pivot O of a pivoting mechanism 3 provided in the cylindrical presser 1 and is pivoted about the pivot O by a lever 4. The cuff 6 is held between an intermediate portion 34 of the spring 31 and the cylindrical surface A of the presser 1. When the sleeve has been pressed, the leaf spring 31 is raised and the shirt is removed. This cuff presser has the following problems.

When the leaf spring 31 is raised as shown in FIG. 11, its head 33 separates from the cuff 6. But the head 33 still overhangs the cuff 6 in this state. Thus, in order to remove the shirt by raising the cuff 6, the slit 7 of the cuff 6 has to be opened widely so that the cuff may not interfere with the leaf spring 31. When the slit 7 is opened, the freshly pressed cuff 6 and sleeve 5 tend to be twisted and thus wrinkled. Only skilled hands could open the slit 7 without twisting the cuff 6 and sleeve 5.

One way to remove the shirt without opening the slit 7 is to press the leaf spring 31 flat against the sleeve stretcher 2. For this purpose, the cuff 6 has to be moved away from the cuff presser 1 by pulling down the sleeve 5. But since the sleeve stretcher 2 has a diameter gradually increasing downwardly from its top, as shown in FIG. 12, the cuff 6 will spread gradually as the sleeve 5 is pulled down, thus creating wrinkles C near the proximal end of the slit 7 as shown in FIG. 13.

An object of this invention is to provide a cuff presser which enables even an inexperienced operator to easily remove a shirt from a sleeve stretcher without wrinkling its sleeves and cuffs.

SUMMARY OF THE INVENTION

According to this invention, there is provided a cuff presser for a sleeve press having a sleeve stretcher, said cuff presser comprising a cylindrical cuff pressing member, a presser means for pressing a cuff of a shirt fitted on said sleeve stretcher, a first cylinder having a rod at one end thereof and mounted in and parallel to said cylindrical cuff pressing member for axially moving said pressing member, a pivoting member pivotably mounted on the top end of said rod of the first cylinder, and a second cylinder having a rod mounted to said pivoting member and mounted in said cylindrical cuff pressing member, parallel to said first cylinder, the presser means having one end thereof secured to said pivoting member, and having its intermediate portion between said one end and the other end protruding outwardly through a groove formed in the side wall of said cylindrical cuff pressing member, said presser means being moved toward and away from the peripheral surfale of said cylindrical cuff pressing member by pivoting said pivoting member by moving the rod of said second cylinder.

The first cylinder may have a greater thrust than the second cylinder so that the rod of the second cylinder is forcibly moved by the rod of the first cylinder.

With this arrangement, the presser means can be opened and closed relative to the peripheral surface of the cuff pressing member at a position remote from the cuff.

Other features and objects of the present invention will become apparent from the following description made with reference to the accompanying drawings, in which:

DETAILED DESCRIPTION OF THE PREFERRED EMBODIMENT

Figure 1:
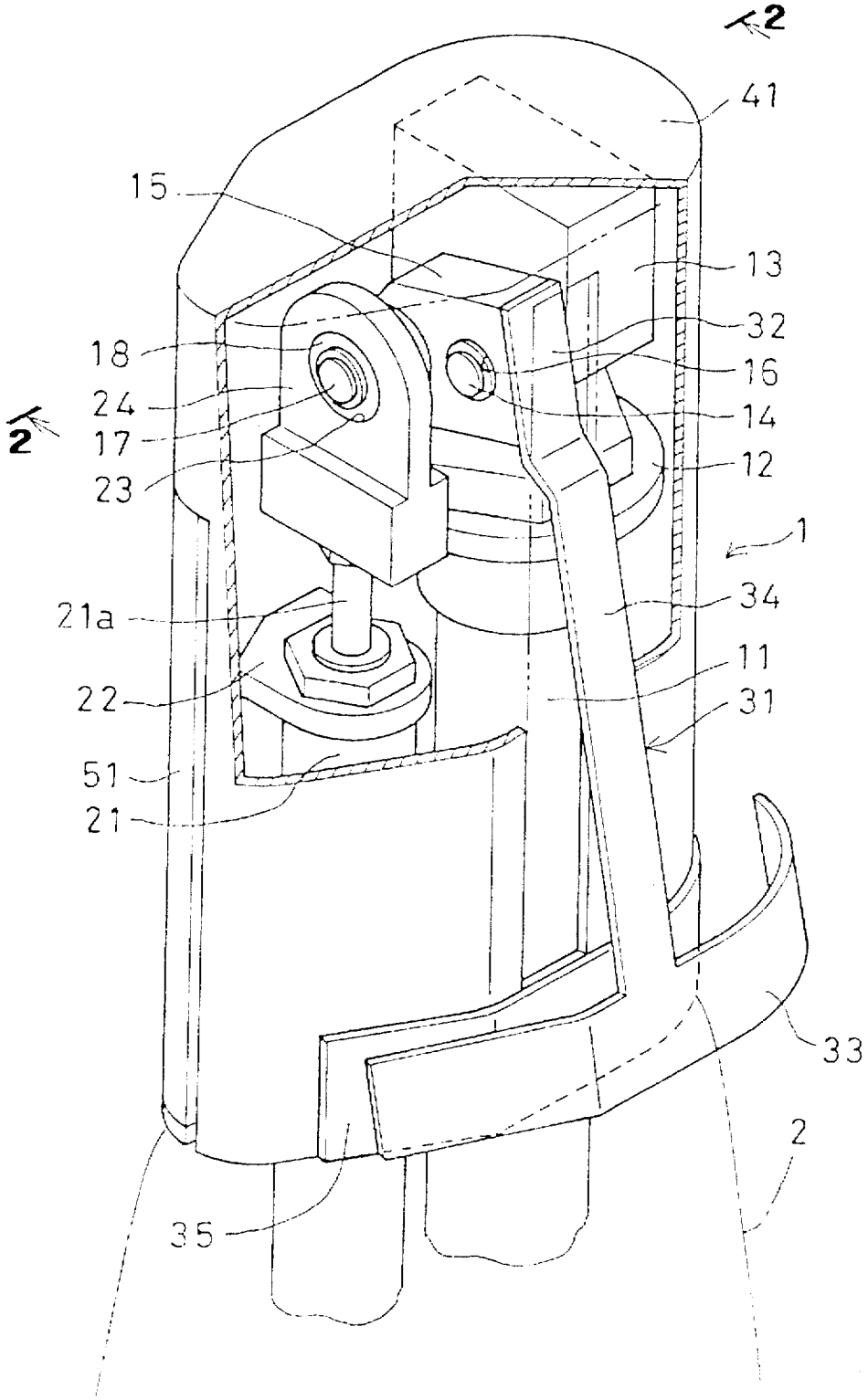
FIG. 1 is a perspective view of an embodiment.
Figure 2:
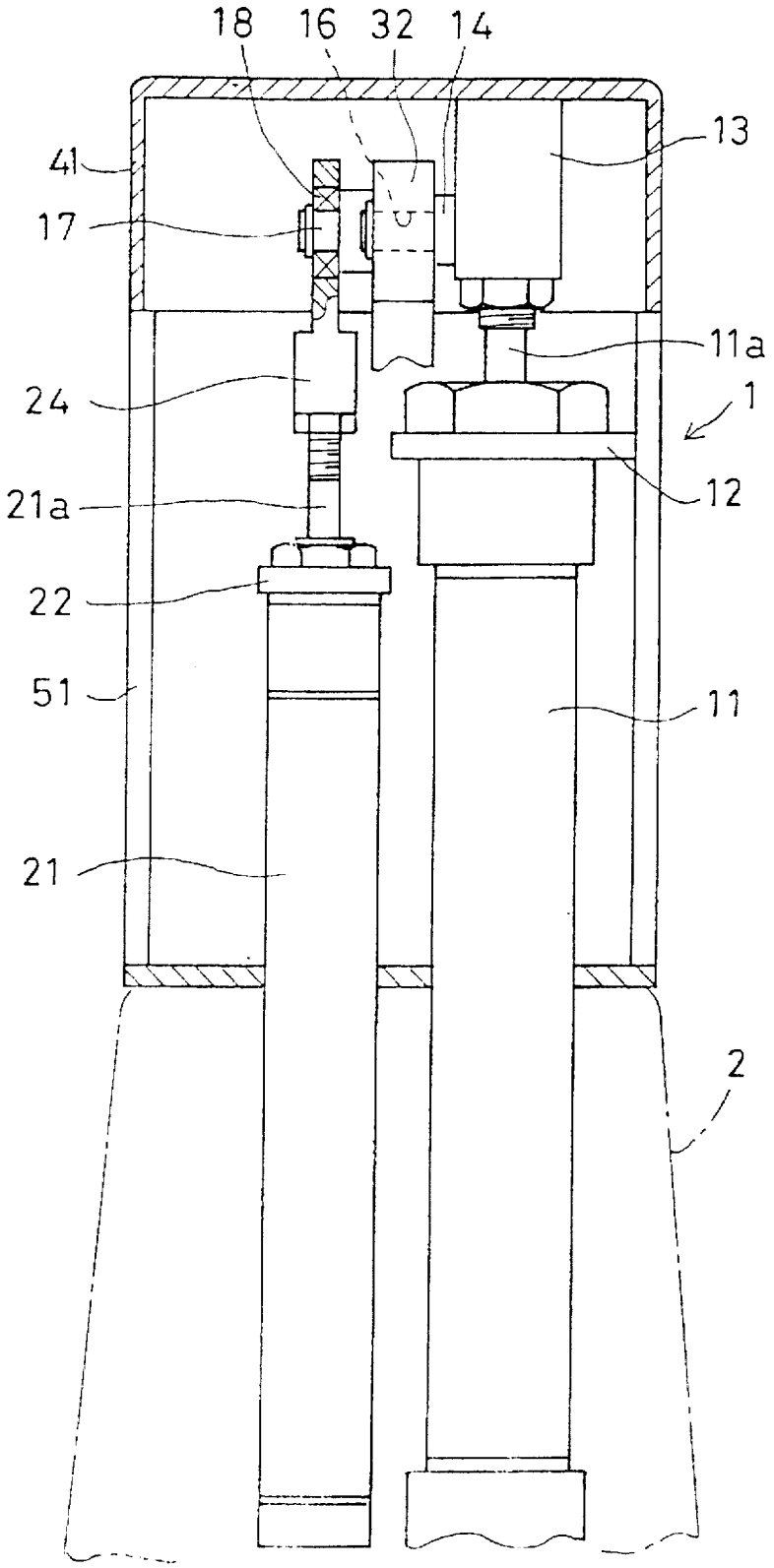
FIG. 2 is a sectional view taken along line 2—2 of FIG. 1.

FIGS. 1–8 show an embodiment of this invention, in which the same elements as those in the prior art are denoted by the same numerals and their description is omitted. As shown in FIGS. 1 and 2, the cuff presser 1 of the embodiment comprises an upper and a lower hollow cylindrical member 41 and 51. The lower cylindrical member 51 has its bottom fixed to the top edge of the sleeve stretcher 2 of the presser, which is shown by chain line in the figures.

Two cylinders 11, 21 are provided in the cylindrical members 41 and 51 to extend parallel to the axes of the cylindrical members 41 and 51, and mounted through brackets 12, 22 to the inner surface of the side wall of the cylindrical member 51. Both cylinders 11, 21 have their bottom ends protruding through a hole formed in the bottom of the cylindrical member 51 into the sleeve stretcher 2.

A metal member 13 is fixed to the top end of the rod 11*a* of the cylinder 11. Its top surface is fixed to the inner surface of the top wall of the cylindrical member 41. A shaft 14 extends horizontally from one side of the metal member 13. It is inserted in a hole 16 of a pivot plate 15 to hold the pivot plate pivotable about the hole 16 in a plane parallel to the sides of the metal member 13. The pivot plate 15 has a stepped shaft 17 adjacent the hole 16 and eccentric with respect to the shaft 14. A bearing 18 is fitted on the tip of the stepped shaft 17.

Figure 5:
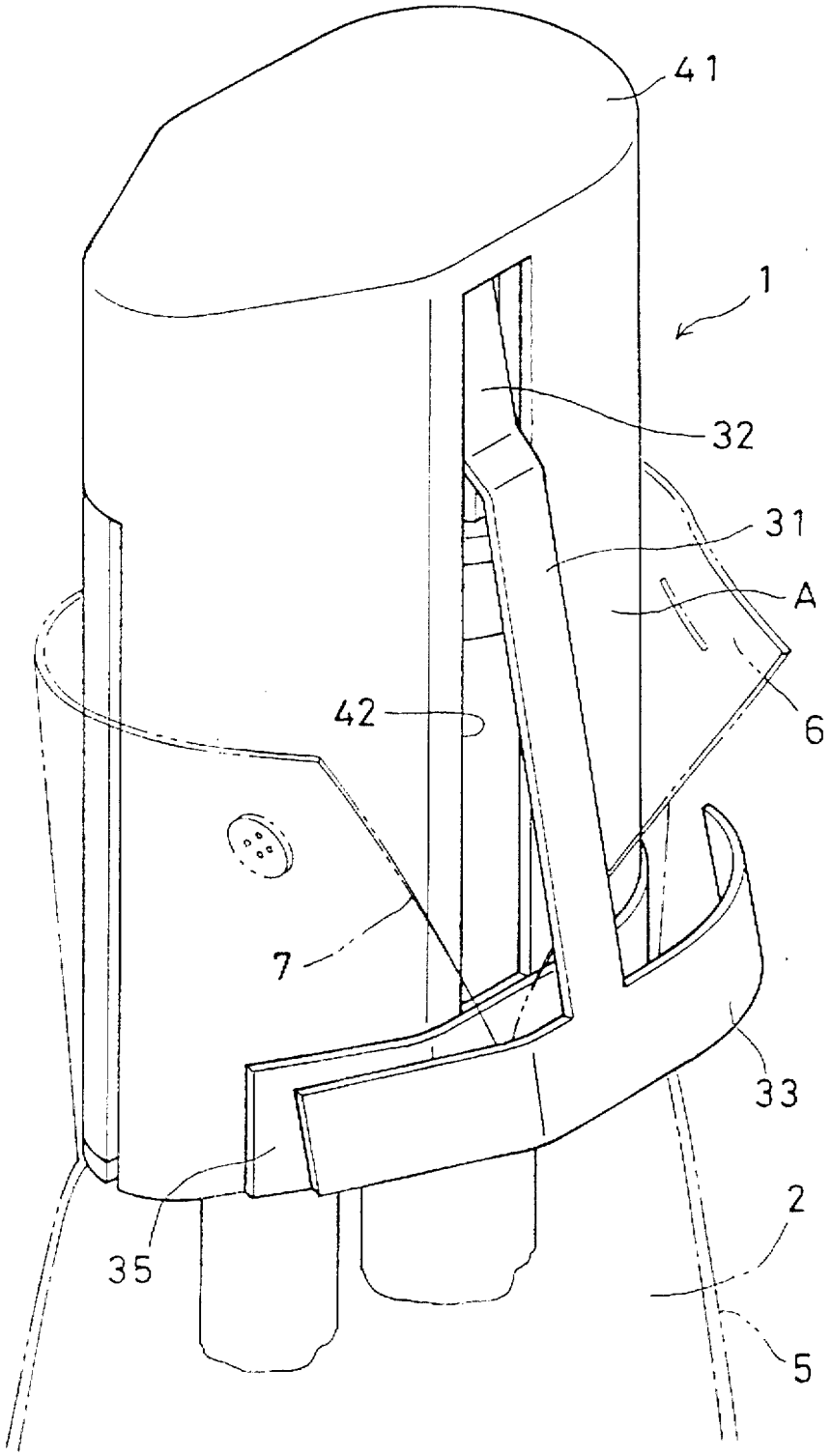
FIG. 5 is a perspective view of the embodiment.
Figure 6:
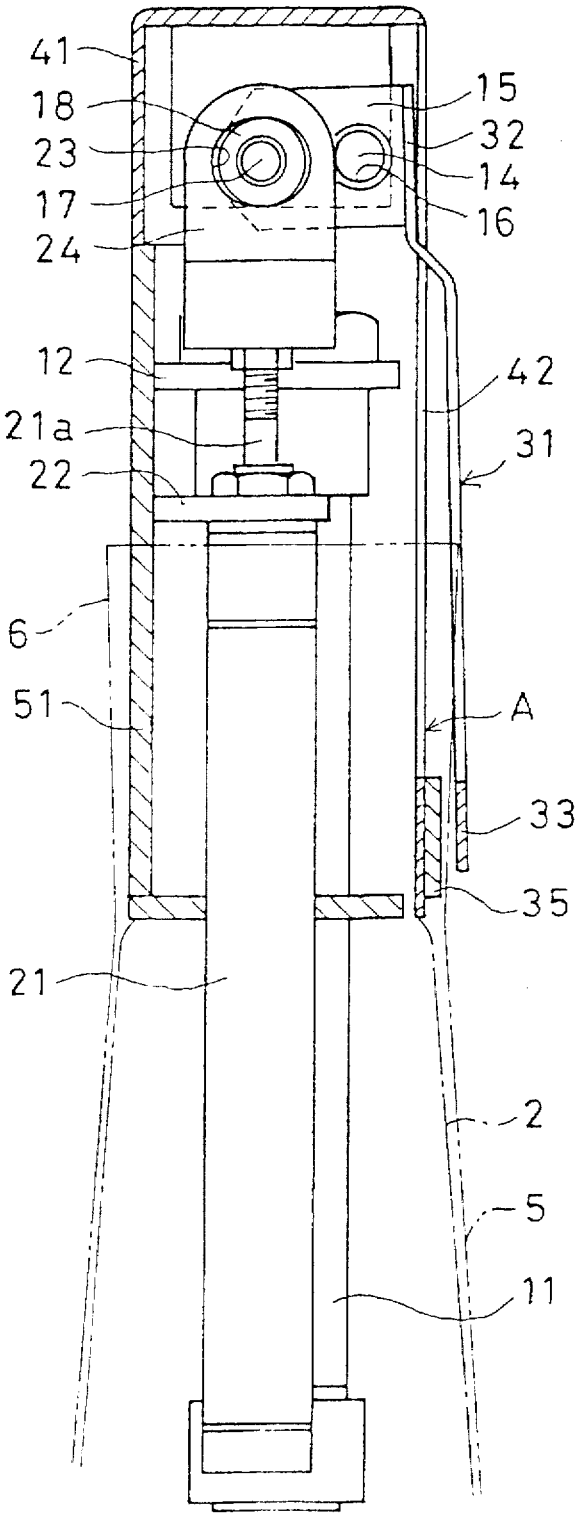
FIG. 6 is a sectional view showing an operational state of the embodiment.
Figure 7:
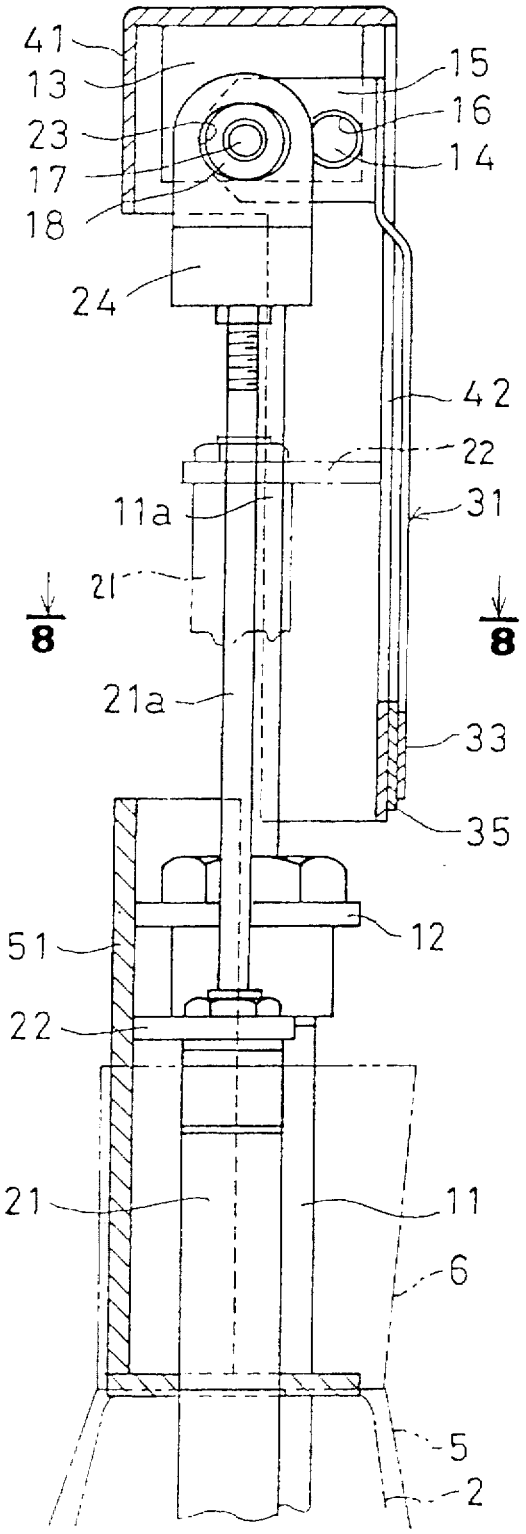
FIG. 7 is a sectional view showing another operational state of the embodiment.

A T-shaped leaf spring 31 (FIG. 1) has its leg 32 fixed to the side of the pivot plate 15 on which the stepped shaft 17 is provided. Its intermediate portion 34 between the leg 32 and the head 33 protrudes through an axial groove 42 formed in the side of the cylindrical member 41 (FIG. 5). When the pivot plate 15 is pivoted, its head 33 moves toward and away from the peripheral surface of the cylindrical member 41. Numeral 35 is an anti-slip rubber plate for receiving the head 33 of the leaf spring 31. It is fixed to the surface of the cylindrical member 41.

The other cylinder 21 has a rod 21*a* having a connecting plate 24 fixedly mounted on its top end. The connecting plate 24 has, as shown in FIG. 1, an oval hole 23 having a minor axis greater than the outer diameter of the bearing 18. The bearing 18 is mounted in the oval hole 23 with a play.

Unillustrated pipes, adjusting valves and other members are connected to the cylinders 11 and 21. But their description is omitted because they are not the essential features of the invention. The cuff presser 1 is operated in the following manner.

Figure 3:
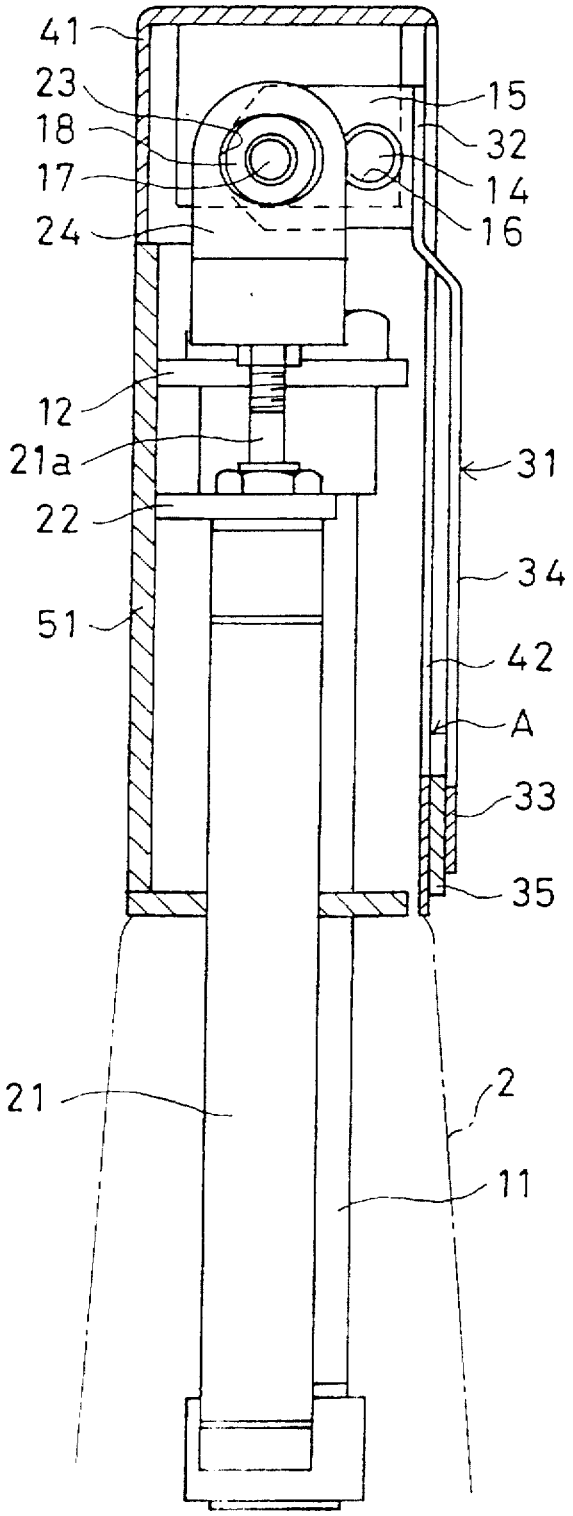
FIG. 3 is a sectional view showing an operational state of the embodiment.

Before fitting a cuff 6 (FIG. 5) on the cuff presser 1, the upper and lower cylindrical members 41 and 51 are moved into close contact with each other as in FIG. 3, and the intermediate portion 34 of the leaf spring 31 is closed, that is, juxtaposed with the outer periphery A of the member 41. In this state, the sleeve 5 is pulled manually over the cuff presser 1 until the tip of the cuff 6 comes to a position below the boundary between the cuff presser 1 and the sleeve stretcher 2.

Figure 4:
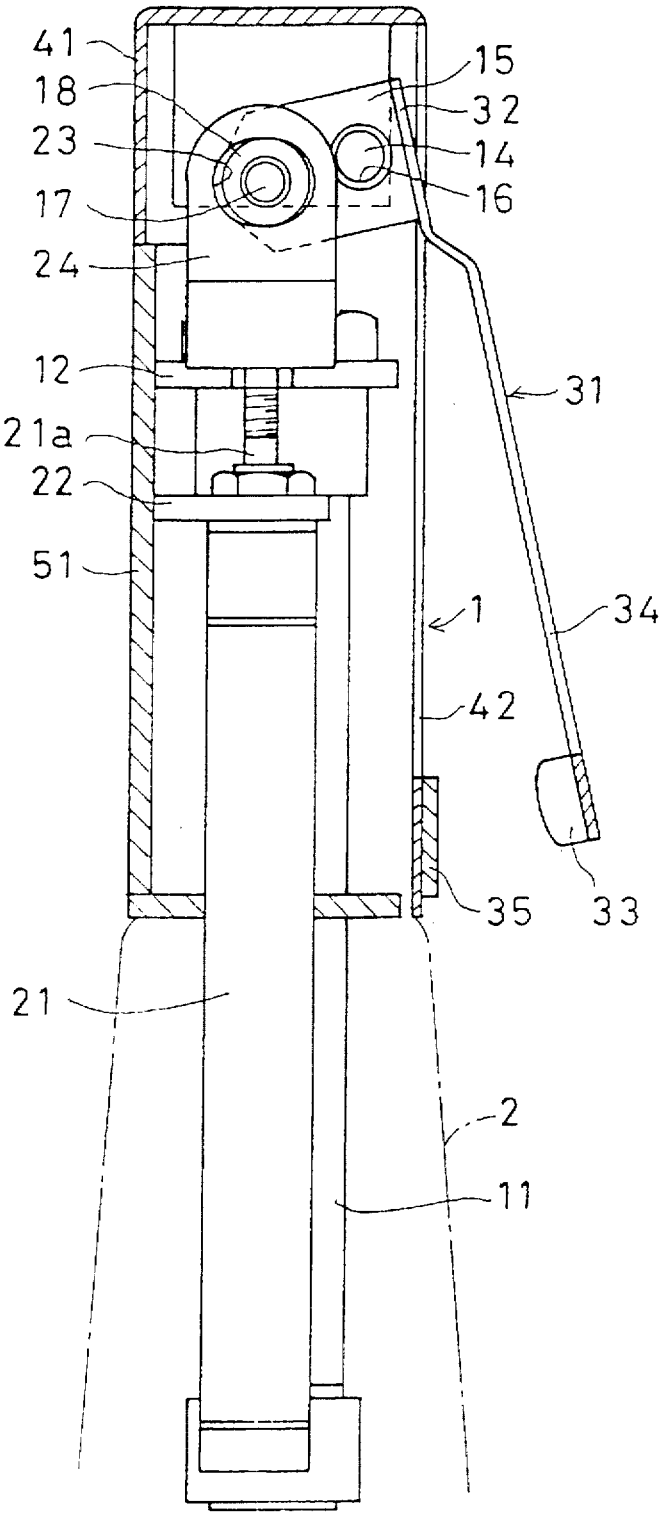
FIG. 4 is a sectional view showing another operational state of the embodiment.

With the shirt held manually in this position, the leaf spring 31 is opened to fix the cuff 6. For this purpose, the rod 21*a* of the cylinder 21 is retracted with the cylinder 11 kept stationary as shown in FIG. 4. As the rod 21*a* retracts, the stepped shaft 17 of the pivot plate 15, which is inserted in the oval hole 23, is pushed down through the bearing 18. Since the shaft 17 is eccentric with respect to the shaft 14, the pivot plate 15 pivots counterclockwise in FIG. 4 about the shaft 14, opening the leaf spring 31.

The leaf spring 31 is then closed to press the cuff 6 against the peripheral surface A of the member 41. Before pressing the cuff, as shown in FIG. 5, the shirt is repositioned manually so that the boundary between the cuff 6 and the sleeve 5 is located on the boundary between the cuff presser 1 and the sleeve stretcher 2 and that the slit 7 of the cuff 6 is opposite to the axis of the leaf spring 31.

To close the leaf spring 31, the rod 21*a* of the cylinder 21 is extended (FIG. 6) with the cylinder 11 kept stationary to pivot the pivot plate 15 in the direction opposite to the direction for opening the leaf spring 31. When the cuff 6 is pressed against the peripheral surface A of the member 41, the operator removes his hand from the cuff 6. The cuff 6 and the sleeve 5 are then pressed by the pressing surface of the press.

When the cuff 6 and sleeve 5 have been pressed, the press is removed from the cuff and sleeve, and the pivot plate 15 is pivoted counterclockwise by retracting the rod 21*a* of the cylinder 21 to open the leaf spring 31. Since the sleeve 5 is kept in close contact with the sleeve stretcher 2 in this state, the shirt will never drop from the sleeve stretcher 2 even when the leaf spring 31 is opened. But the cuff 6 is not in close contact with the peripheral surface of the cuff presser 1. Rather, there is a gap between the cuff and the peripheral surface A of the cuff presser 1 (peripheral surfaces of the cylindrical members 51, 41) with the slit 7 opened by weight of the cuff 6.

In this state, in order to close the leaf spring 31, the cylindrical member 41, to which the spring 31 is mounted, is raised away from the lower cylindrical member 51 around which the cuff is fitted. To keep the leaf spring 31 open, the cylinder 21 is kept retracted. In this state, the cylinder 11, to which the cylindrical member 41 is mounted, is activated to extend the rod 11*a*. Since the thrust of the cylinder 11 is greater than that of the cylinder 21, the rod 11*a* rises while pulling the rod 21*a*, which is kept retracted.

While the rod 11*a* is rising, the bearing 18 and the stepped shaft 17 of the pivot plate 15 are pushed down because the stepped shaft 17 is eccentric to the shaft 14. Thus, a counterclockwise pivoting force keeps acting on the pivot plate 15, keeping the leaf spring 31 locked in the open position while it is rising together with the cylindrical member 41. If the sliding resistance produced inside the cylinder 21 is utilized, this resistance acts as a force to retract the rod 21*a*, making it possible to reduce the thrust of the cylinder 21 to zero by releasing the supply of air pressure to the cylinder 21. Energy cost can thus be saved.

It is important that the rod 11*a* of the cylinder 11 be extended so that the cylindrical member 41 rises until the leaf spring 31 is moved to a position where its bottom end is located above the top end of the cuff 6.

The reason why the hole 23 formed in the connecting plate 24 to receive the bearing 18 with a play is oval in shape is because no lateral load acts on the cylinder 21 when the bearing 18 bears on the wall of the hole 23. The hole 23 needs not be oval in a strict sense but may be any laterally elongated round hole having a minor axis greater than the outer diameter of the bearing 18.

Also, in order to prevent lateral loads, the cylinder 21 may be mounted to the cylindrical member 51 by a clevis means with the bearing 18 mounted in a completely circular hole with a play.

When the cylindrical member 41 has raised to its upper limit, the rod 21*a* of the cylinder 21 is extended while keeping the cylinder 11 stationary to close the leaf spring 31.

The cylinder 11 is then activated to retract the rod 11*a* and lower the cylindrical member 41. In order to keep the leaf spring 31 closed while the cylindrical member 41 is being lowered, the rod 21*a* of the cylinder 21 is kept in a state in which it tends to extend. In this state, the cylinder 11, to which the cylindrical member 41 is mounted, is activated to retract the rod 11*a*. The thrust of the cylinder 11 when it is lowered, as when it is raised, is greater than that of the cylinder 21, so that the rod 11*a* descends while pulling down the rod 21*a*, which tends to extend. Thus, while the rod 11*a* of the cylinder 11 is retracting, the leaf spring 31 is lowered together with the cylindrical member 41 while being kept locked in its closed position. If the sliding resistance produced inside the cylinder 21 is utilized, this resistance acts as a force to extend the rod 21*a*, making it possible to reduce the thrust of the cylinder 21 to zero by releasing the supply of air pressure to the cylinder 21. It is thus possible to save the energy cost as when the rod is raised.

When the leaf spring 31 is pressed against the peripheral surface A of the member 41, the leaf spring 31 protrudes from the peripheral surface A (FIG. 8) only by the distance equal to the sum of the thicknesses of the leaf spring 31 and the rubber plate 35. In this state, the cylindrical member 41 is lowered toward the cylindrical member 51 around which the cuff 6 is fitted. As mentioned earlier, the cuff 6 is opened outwardly from the peripheral surface A of the cylindrical member 51 by its own weight. Thus, even when the cylindrical member 41 is lowered and its bottom end and the leaf spring 31 are inserted into the cuff 6, none of the peripheral surface A, leaf spring 31 and rubber plate 35 will interfere with the cuff 6.

Figure 8:
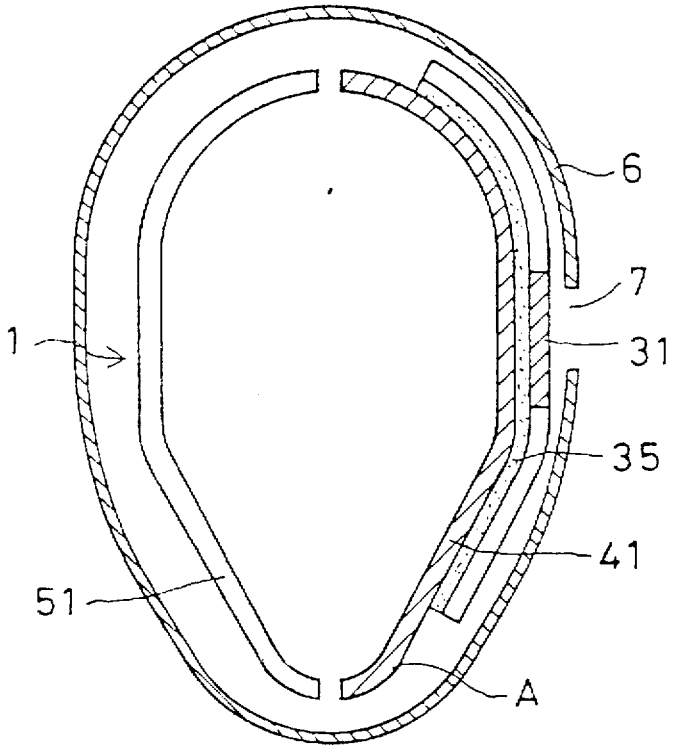
FIG. 8 is a sectional view taken along line 8—8 of FIG. 7.
Figure 9:
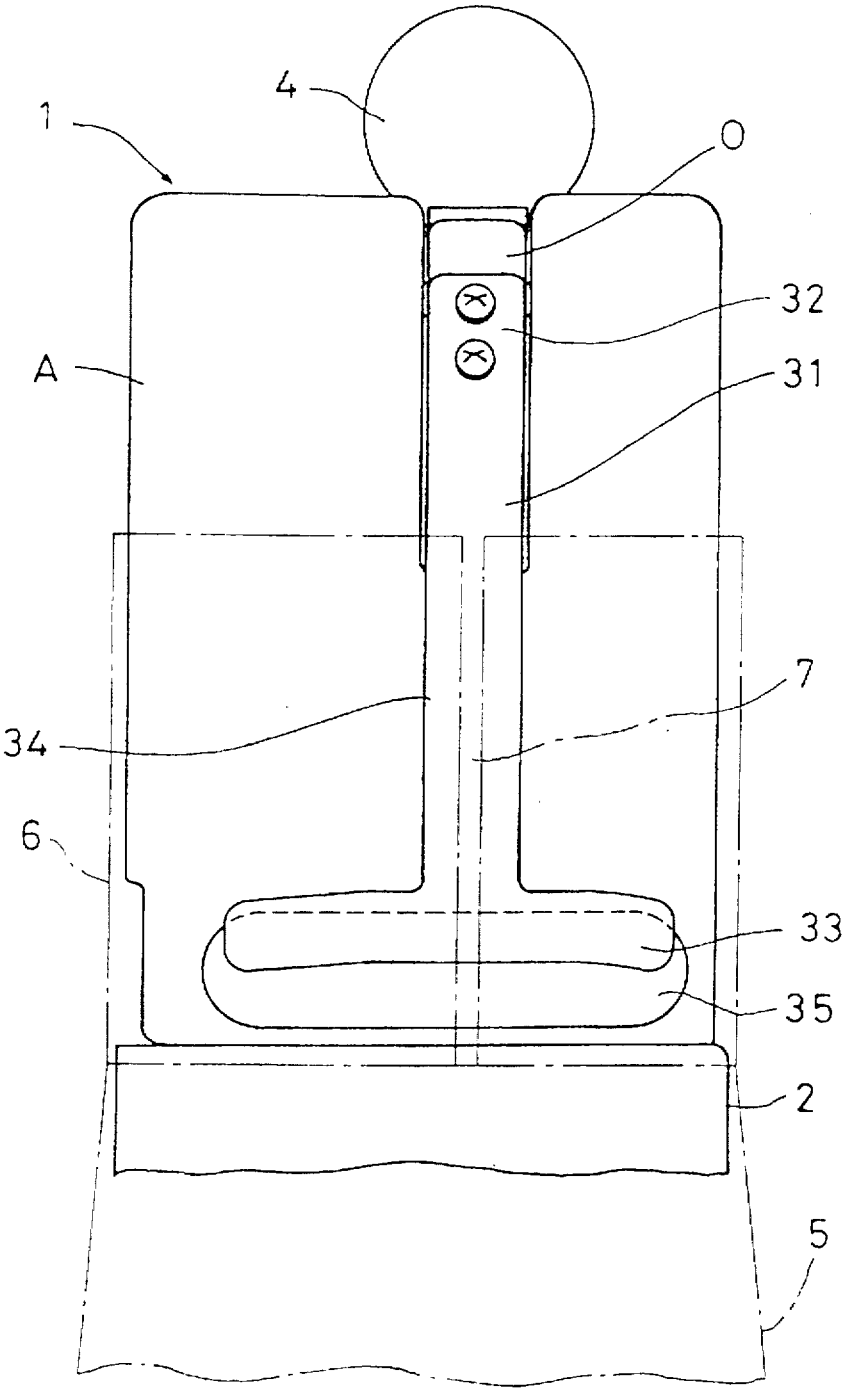
FIG. 9 PRIOR ART
FIG. 9 is a view of the prior art.
Figure 10:
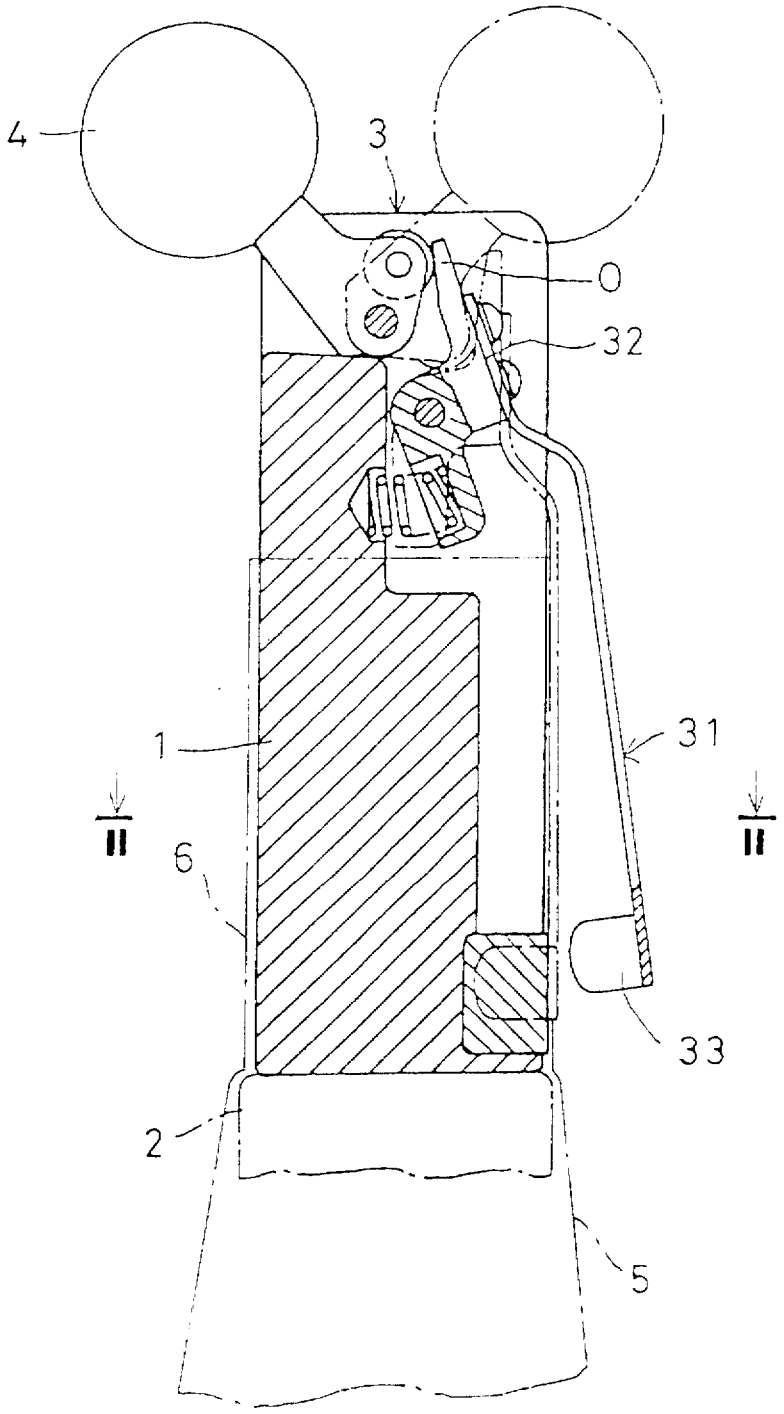
FIG.10 PRIOR ART
FIG. 10 is a side view in section of FIG. 9.
Figure 11:
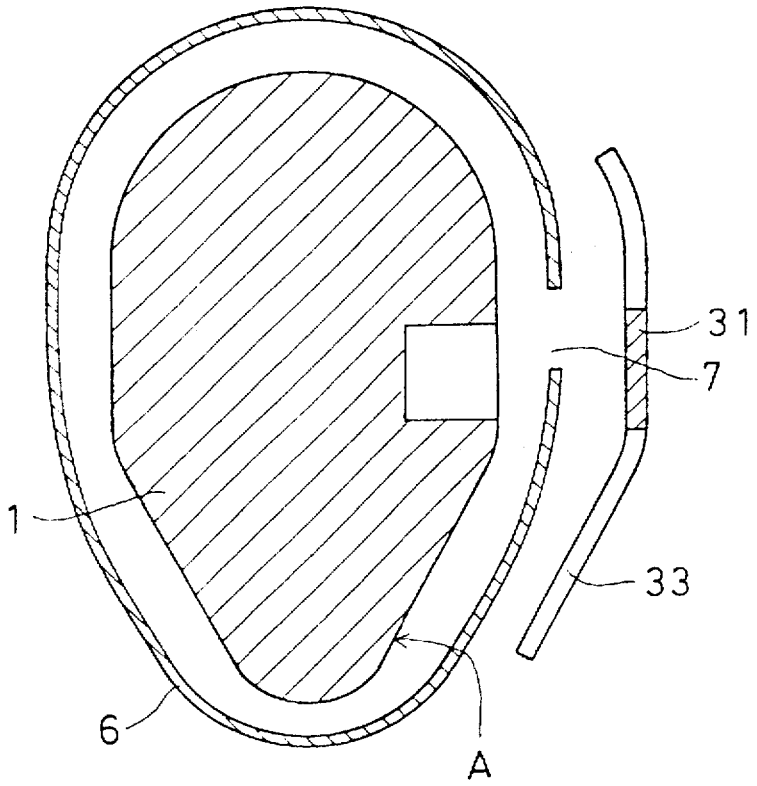
FIG.11 PRIOR ART
FIG. 11 is a sectional view taken along line 11—11 of FIG. 10.
Figure 12:
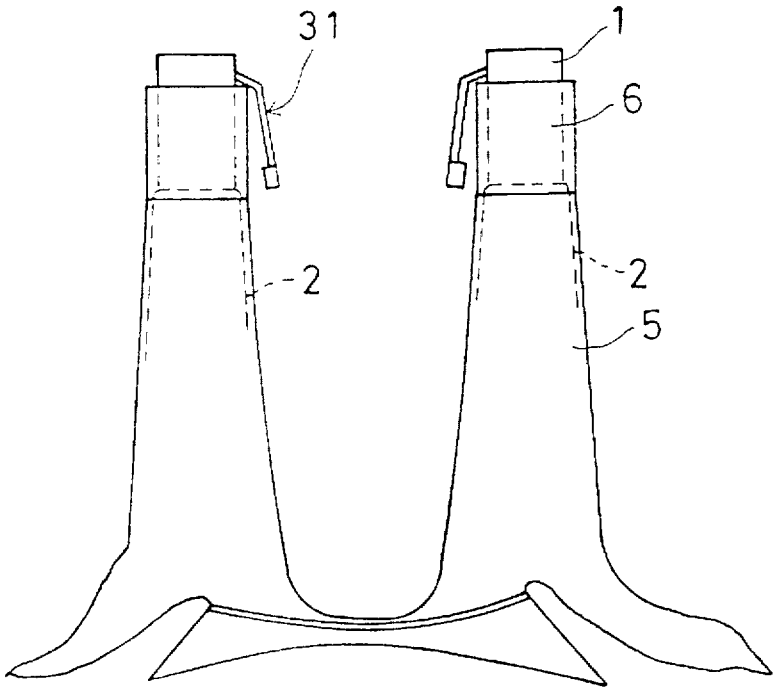
FIG.12 PRIOR ART
FIG. 12 is a schematic view showing the operation of the prior art.
Figure 13:
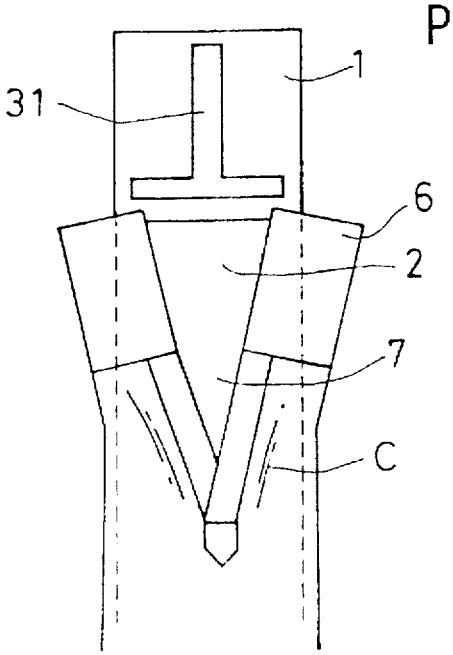
FIG.13 PRIOR ART
FIG. 13 is a partial detailed view of FIG. 12.

When the cylindrical member 41 is lowered until it abuts the cylindrical member 51, the shirt is removed from the sleeve stretcher 2 by picking up its cuff 6 by hand. There is enough space between the sleeve 5 and the peripheral surface A of the cylindrical member 41, as shown in FIG. 8, so that even an unskilled operator can easily remove the shirt without the possibility of the sleeve 5 getting caught on the cuff presser 1 or being wrinkled.

In this embodiment, the cuff presser 1 comprises two separate cylindrical members 41 and 51. But instead, a single, integral cylindrical member may be used. In this case, the cylinders 11, 21 are fixedly mounted in e.g. the sleeve stretcher 2 under the cuff presser 1 to move the integral cylindrical member up and down.

The cylinder 21 may be adapted to rise up and down together with the cylinder 11. For this purpose, the cylinder 21 may be fixed to the inside of the vertically movable cylindrical member 41.

As described above, by using the cuff presser according to this invention, even an inexperienced operator can easily remove a shirt from the sleeve stretcher without wrinkling the sleeve.

What is claimed is:

1. A cuff presser for a sleeve press having a sleeve stretcher, said cuff presser comprising;

a cylindrical cuff pressing member, a presser means for pressing a cuff of a shirt fitted on said sleeve stretcher, a first cylinder having a rod at one end thereof and mounted in and parallel to said cylindrical cuff pressing member for axially moving said pressing member, a pivoting member pivotably mounted on the top end of said rod of the first cylinder, and a second cylinder having a rod mounted to said pivoting member and mounted in said cylindrical cuff pressing member, parallel to said first cylinder, said presser means having one end thereof secured to said pivoting member, and having its intermediate portion between said one end and the other end protruding outwardly through a groove formed in the side wall of said cylindrical cuff pressing member, said presser means being moved toward and away from the peripheral surface of said cylindrical cuff pressing member by pivoting said pivoting member by moving the rod of said second cylinder.

2. A cuff presser as claimed in claim 1 wherein said first cylinder has a greater thrust than said second cylinder, whereby the rod of said second cylinder is forcibly moved by the rod of said first cylinder.

* * * * *